US008002512B1

(12) United States Patent
Blehm

(10) Patent No.: US 8,002,512 B1
(45) Date of Patent: Aug. 23, 2011

(54) MATERIAL TRANSPORT

(76) Inventor: Berle G. Blehm, Oroville, CA (US)

( * ) Notice: Subject to any disclaimer, the term of this patent is extended or adjusted under 35 U.S.C. 154(b) by 0 days.

(21) Appl. No.: 12/642,540

(22) Filed: Dec. 18, 2009

Related U.S. Application Data

(60) Provisional application No. 61/148,257, filed on Jan. 29, 2009.

(51) Int. Cl.
*B28C 7/08* (2006.01)

(52) U.S. Cl. ..... 414/598; 182/103; 414/595; 414/599

(58) Field of Classification Search ..... 182/102, 182/103, 115, 117, 2.5, 36, 37, 38, 141; 414/571, 414/595, 630, 651, 672, 652, 583, 598, 599, 414/628, 629, 631, 10, 22.65, 22.57, 22.59, 414/276

See application file for complete search history.

(56) References Cited

U.S. PATENT DOCUMENTS

| | | | | | |
|---|---|---|---|---|---|
| 976,240 | A | | 11/1910 | Winkler | |
| 2,588,959 | A | | 3/1952 | Campbell | |
| 3,115,211 | A | | 12/1963 | Ostrander | |
| 3,428,145 | A | | 2/1969 | Lyon | |
| 3,476,212 | A | * | 11/1969 | Eakins | 182/103 |
| 3,666,054 | A | | 5/1972 | Ellings et al. | |
| 3,891,062 | A | * | 6/1975 | Geneste | 187/245 |
| 4,183,423 | A | | 1/1980 | Lewis | |
| 4,546,853 | A | | 10/1985 | Hanson | |
| 4,546,854 | A | * | 10/1985 | Bocker | 182/103 |
| 4,625,944 | A | * | 12/1986 | Mankey et al. | 254/8 R |
| 4,706,779 | A | * | 11/1987 | Bono | 182/2.11 |
| 4,793,437 | A | * | 12/1988 | Hanthorn | 182/102 |
| 4,930,599 | A | | 6/1990 | Simms | |
| 5,139,108 | A | | 8/1992 | Pate | |
| 5,911,287 | A | | 6/1999 | Campbell | |
| 6,244,381 | B1 | | 6/2001 | Ruble | |
| 6,533,070 | B1 | | 3/2003 | Elrod | |
| 7,424,932 | B1 | | 9/2008 | Murphy | |

FOREIGN PATENT DOCUMENTS

| | | |
|---|---|---|
| GB | 2420819 | 7/2006 |

* cited by examiner

*Primary Examiner* — Saul Rodriguez
*Assistant Examiner* — Glenn Myers
(74) *Attorney, Agent, or Firm* — William Bodnar

(57) ABSTRACT

A material transport system and method of use is disclosed herein. The system includes a base assembly having an adjustable width, a material support platform hingedly attached to the base assembly, the platform supported angularly above the base assembly by at least two support tubes hingedly attached to the base assembly, a left pair and a right pair of rail guides aligned along the length of the base assembly, the rails removably attached to the underside of the base assembly, and a left pair and a right pair of wheels axially mounted between each rail guide pair, the bottom edges of the rail guides extending past the edges of the wheels, the system characterized in that the rail guides and wheels enable the transport system to be pulled along the rails of a ladder by wire, rope, or like component attached to the transport system.

7 Claims, 8 Drawing Sheets

MATERIAL TRANSPORT

CROSS REFERENCE TO RELATED APPLICATIONS

This application claims priority from U.S. Provisional Patent Application No. 61/148,257 filed Jan. 29, 2009. The contents of U.S. Provisional Patent Application 61/148,257 are incorporated herein by reference.

FIELD OF THE INVENTION

This present invention relates to a device for transporting materials up a ladder.

BACKGROUND OF THE INVENTION

The present invention relates generally to hoisting systems and, more particularly, to a portable folding platform apparatus which may be used in conjunction with a ladder to elevate materials from the ground to the eave of a roof and/or raise materials from the eave of a roof to the peak of a roof.

Extreme difficulty is often encountered in lifting heavy objects to the top of a house, onto a roof, or from the eave of a roof to the roof peak. This can be accomplished with a crane, but the expense of using a crane is often prohibitive. For example, it would be too expensive to rent a crane to transport roofing materials from the ground to the roof or from the eave of a roof to the roof peak. In addition, it would be difficult and expensive to transport a large piece of equipment such as a crane to a job site. If obstacles do not permit a lifting machine to be used to lift materials from the ground to the roof eave, this form of equipment can be used for that purpose.

There is a need for an apparatus that can be easily attached to a single section ladder or an extension ladder and used to lift loads to the eave of a roof of a building. The portability of such an apparatus is important so that it can be transported by one person to and from a jobsite easily and can be affixed to and removed from a ladder by a worker with a minimum of effort. The apparatus should be capable of functioning on a single section ladder or an extension ladder which includes at least two sections of ladder with different widths.

Accordingly, there is a need for a portable folding apparatus that may be used in conjunction with a ladder to lift loads to the eave or peak of a roof of a building. There is a further need for an apparatus that may be easily adjusted to fit the width of a particular ladder. The apparatus should be capable of being folded into a compact form so that it may be easily transported to a job site. Moreover, the apparatus should also be capable of being used with a winch so that heavy loads may be lifted to the top of the ladder. And finally, the apparatus should be capable of being utilized with a single section ladder or an extension ladder with more than one ladder section.

SUMMARY OF THE INVENTION

In accordance with one embodiment of this invention, a portable folding platform apparatus for lifting a load and for use preferably with a ladder is disclosed. The material transport device comprises a material tray or platform to hold the load; a base unit operably coupled to the material tray, and adjustable support components for supporting the material tray in the proper position.

The base of the material transport is adjustable to the dimensions of a ladder attached thereto. The transport has wheels that at least partially ride on the rails of a ladder. Rail guides affixed to the underside of the transport help position the apparatus on the ladder so that the wheels can utilize the rails as a "track". Transition ramps are utilized on extension ladders to allow the material transport wheels to travel from the rails of the lower, wide section of the ladder to the upper, narrower section. In one embodiment of the invention, the material transport device can have additional components and be utilized to move cumbersome articles, such as solar panels, plywood, doors, windows, etc.

It is an object of an embodiment of the invention to provide an improved, portable folding platform apparatus which may be used with a single section ladder or an extension ladder and is adjustable to fit varying widths of single section or extension ladders. It is another object to provide an improved, portable folding platform apparatus which may be folded up and easily transported to a job site.

It is still another object to provide an improved, portable folding platform apparatus which may be used to lift heavy loads to the top of a house or building or onto a roof. Another object is to provide an apparatus that can be utilized to transport a material load up an extension ladder from the wide, base section of the ladder to the narrower, upper section of the ladder.

Embodiments of the present invention can also be utilized to move a material load from the eave of the roof to the peak of the roof without damaging the roof structure. At least one of the stated objects will be satisfied by embodiments of the present invention.

The foregoing and other objects, features and advantages of this invention will be apparent from the following, more particular, description of the preferred embodiments of the invention, as illustrated in the accompanying drawings.

BRIEF DESCRIPTION OF DRAWINGS

The character of the embodiments of the invention, however, may be best understood by reference to its structural form, as illustrated by the accompanying drawings.

DETAILED DESCRIPTION OF THE PREFERRED EMBODIMENTS

Adjustable outside rail guides and inside rail guides are on each side of the wheels. The outside rail guides contact the outside rail of the wide, base section of a ladder when necessary to help align the wheels on the ladder rail. The inside rail guides can contact the inside rail of the narrow, upper section of a ladder in a similar fashion.

Figure 1:
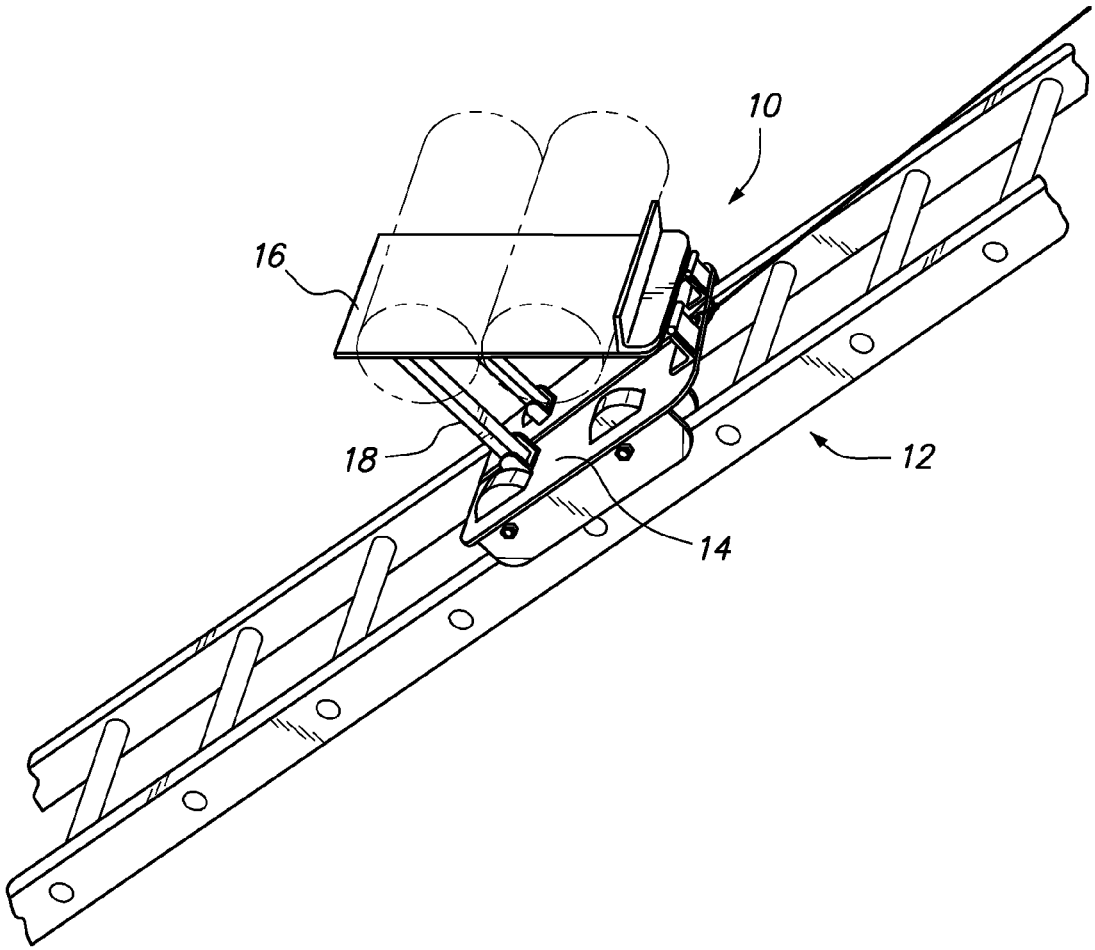
FIG. 1 illustrates the material transport device on a ladder.

Referring to FIG. 1, which shows the general features of a preferred embodiment of the invention, the material transport 10 is comprised of a base section 14 and an adjustable tray section 16 hingedly connected to the base. Support tubes 18 allow for adjustment of the tray to accommodate various roof pitches. The support tubes are pivotally/hingedly connected to the base section. The rooftop material transport is shown in position on a ladder 12 in FIG. 1.

Figure 2:
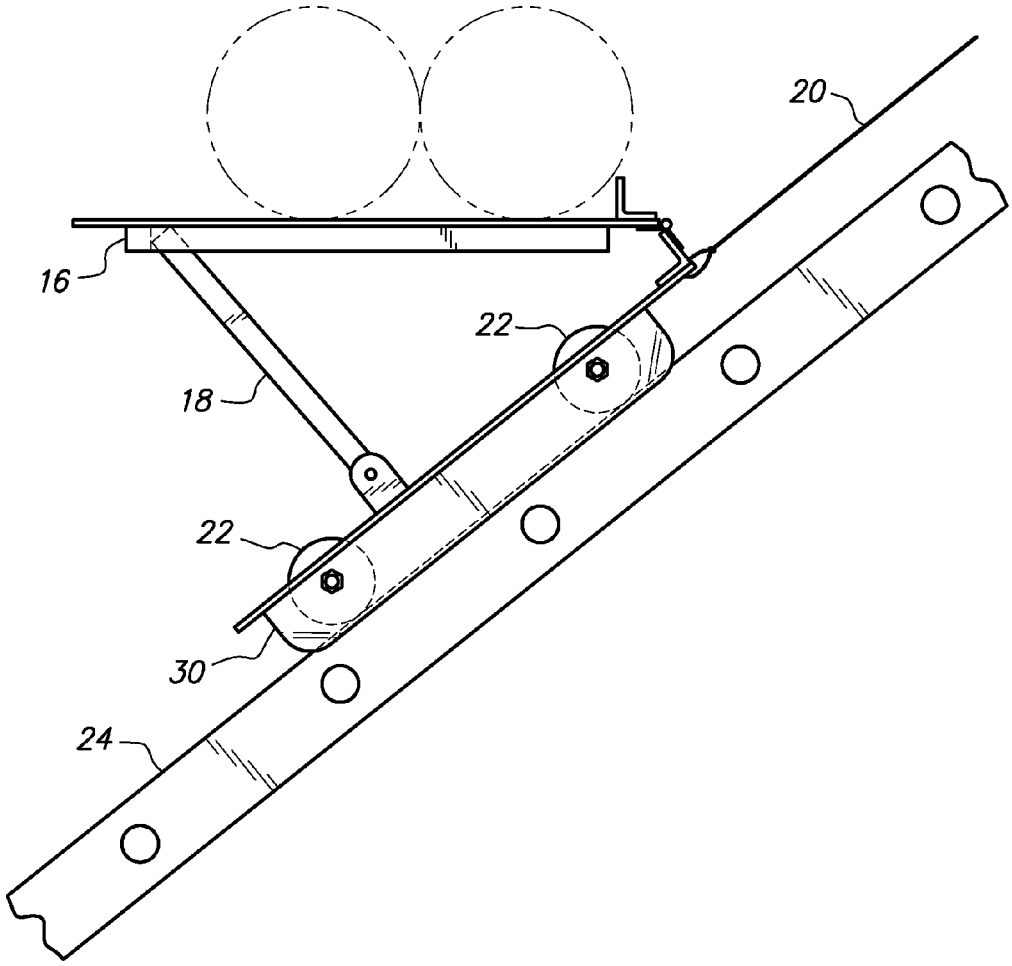
FIG. 2 presents a side view of the material transport on a ladder.

FIG. 2 presents a side view of the material transport device on a ladder angled against a structure (not shown). The tray section 16, connected to the base section via hinge 17, is supported by the support components 18 to position the tray approximately parallel to the ground. The support components are typically telescoping tubes that can be adjusted to length to set the desired angle of the tray section roughly parallel to the ground. The top end of the support components rest against a portion of the bottom of the tray section when the material transport is in position on a ladder (see FIG. 1). A wire 20, rope or other suitable component is used to pull the material transport device. The material transport travels via wheels 22 along the ladder rails 24. Material transport guides aid in keeping the material transport on the ladder rails.

Figure 3:
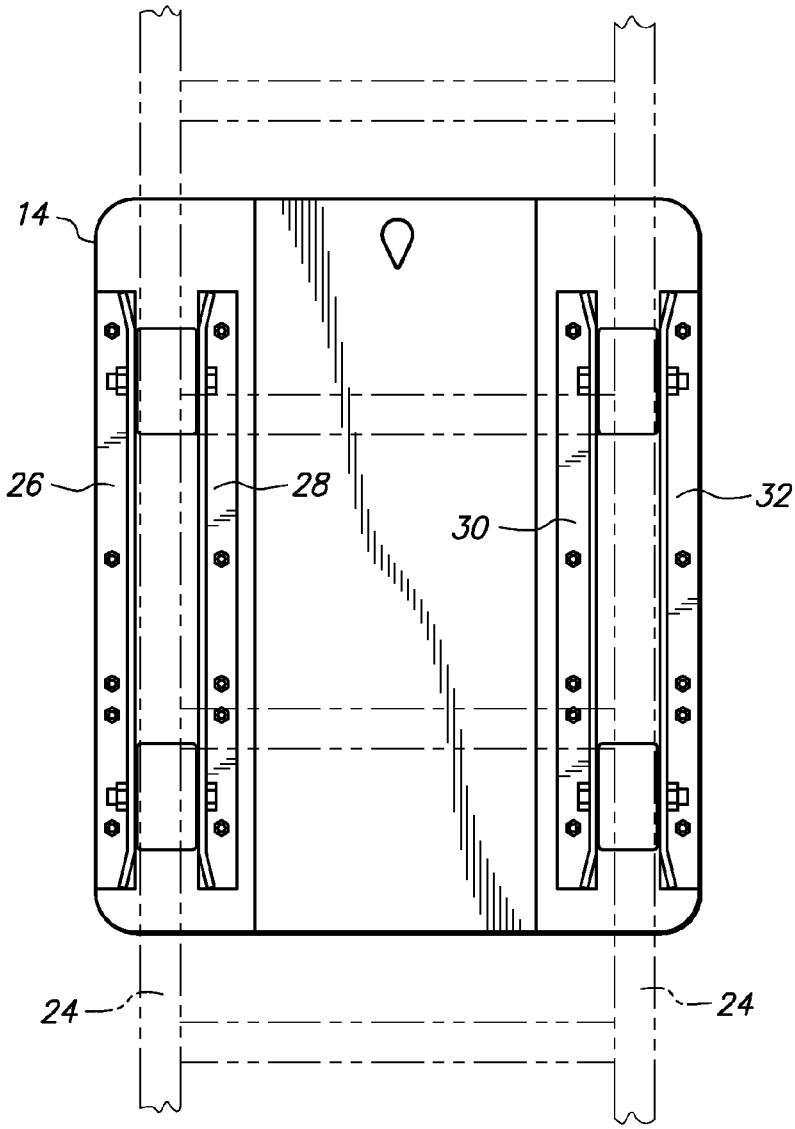
FIG. 3 shows components from the bottom side of the rooftop material transport base.
Figure 4:
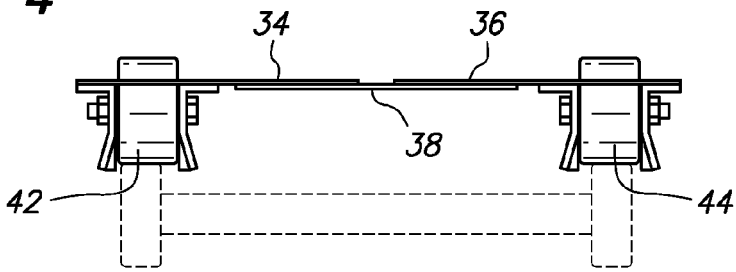
FIG. 4 shows the end view of the device as illustrated in FIG. 3.

FIG. 3 presents a bottom view of the underside of the base section 14 and FIG. 4 shows an end view of the configuration of FIG. 3. The tray section of the material transport is not shown to provide clarity for the components of the base. The base section 14 is comprised of a top left section 34 and a top right section 36 and a bottom section 38. The left side wheels 42 and the left rail guides 26 and 28 are attached to the top left section 34 of the base. The right wheels 44 and the right rail guides 30 and 32 are attached to the top right section 36 of the base. The top sections 34, 36 are adjustable in relation to the bottom section 38 to adjust the wheels and rail guides to mate with ladder rails of a ladder's specific width. The adjustment mechanisms are not shown in the drawings. Typically the rail guides are adjusted so that the outside rail guides 26, 32 are in close proximity to the outside of the ladder rails.

The end portions 33 of the rail guides 26-32 are flared to aid in travel along single section ladders and aid in transition from lower to upper ladder sections on extension ladders. The rail guides also extend below the top of the ladder rail as shown in FIG. 4 to keep the material transport device on the ladder rail "track".

Figure 5:
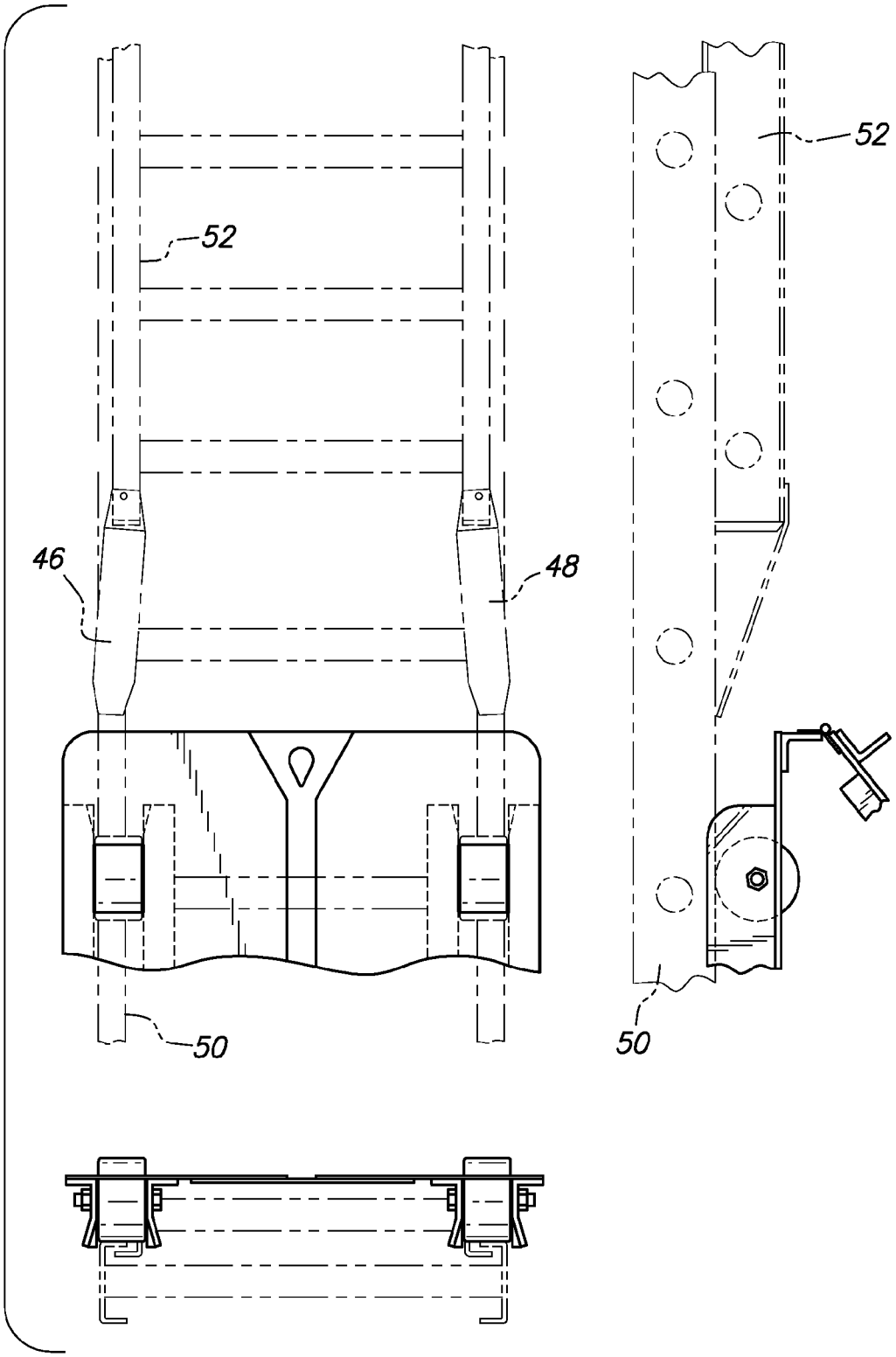
FIG. 5 contains top, side and end views of the material transport on the lower section of an extension ladder positioned just before transition ramps between the lower and upper section of an extension ladder.

FIG. 5 shows the top, side and end views of the material transport base section on the lower section of a ladder positioned just below transition ramps 46, 48 between the lower 50 and upper 52 sections of the extension ladder. The wheels of the material transport device travel on the ladder rails and the transition ramps between the ladder sections. As shown in FIG. 5, the outside portion of the wheel contact surface is utilized when the wheels travel on the lower section of a ladder. The left side illustrates that a portion of the transition ramp 46 extends below the top of the ladder rail. This aids in positioning the material transport relative to the ladder rails.

Figure 6:
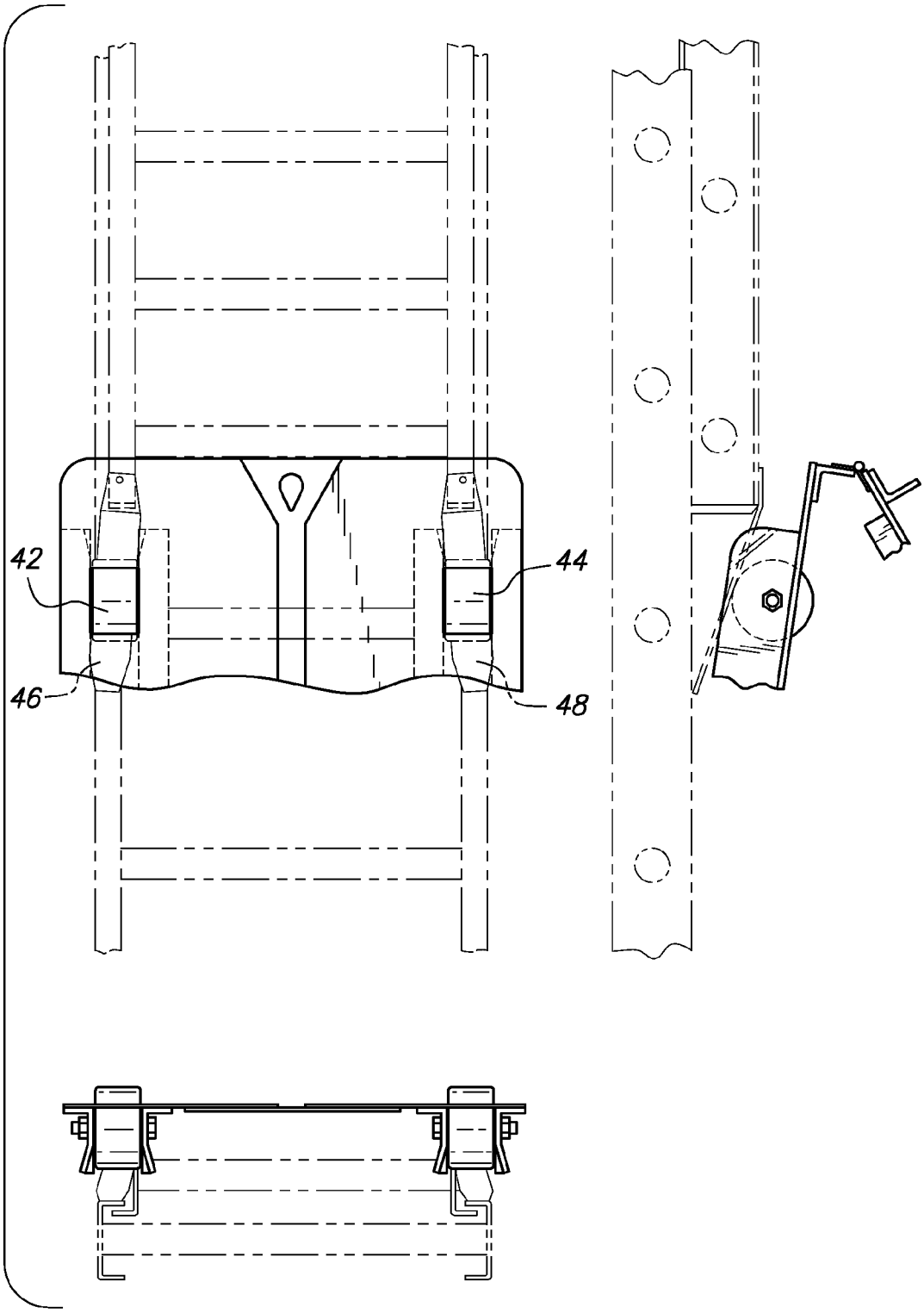
FIG. 6 contains top, side and end views of the material transport as it is positioned near the midpoint of transition ramps between the lower and upper section of an extension ladder.

The material transport is illustrated at its position approximately halfway up the transition ramps in the FIG. 6 views. At this point of travel, the wheels' contact surface with the transition ramps is predominately towards the center of the wheels.

Figure 7:
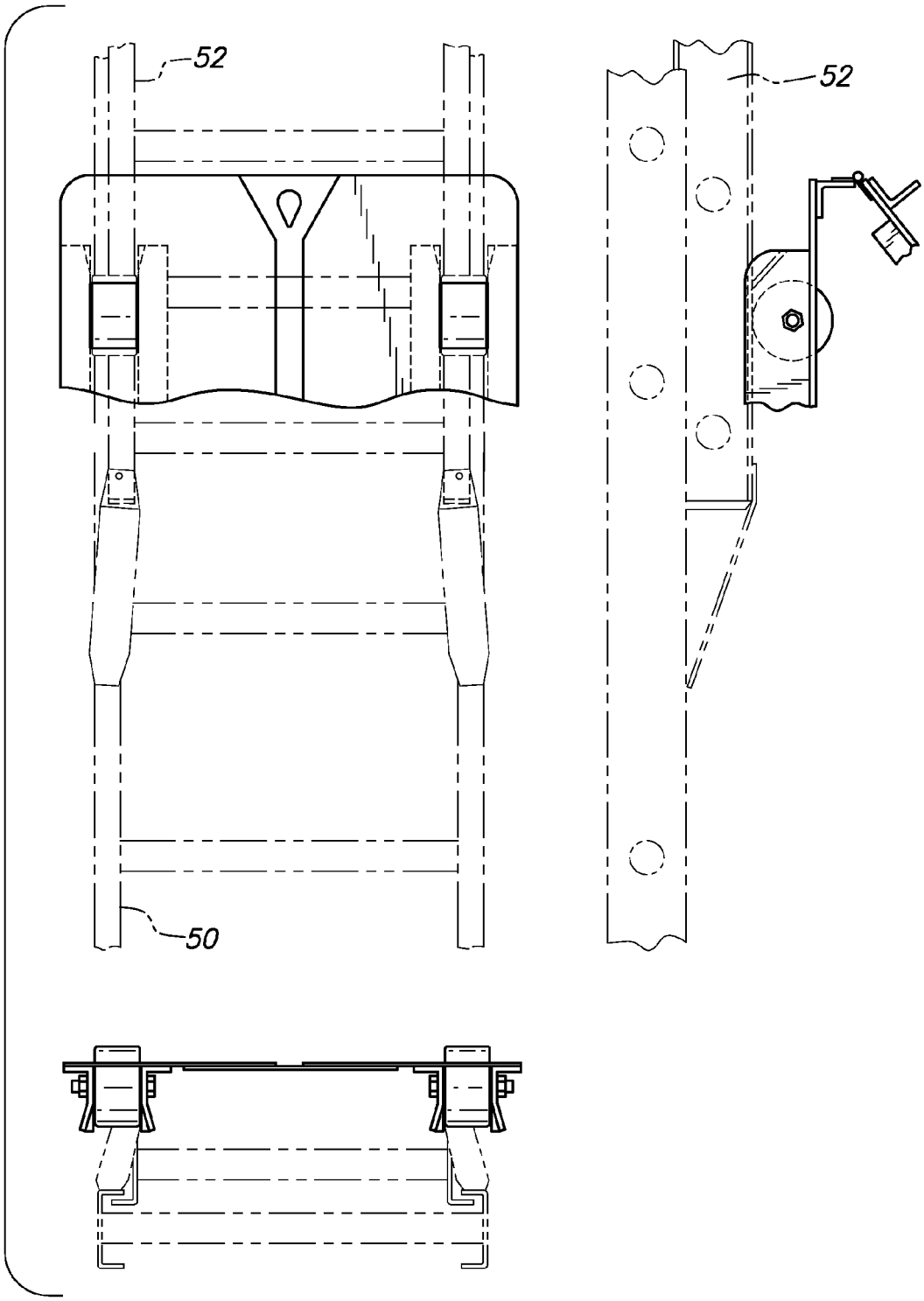
FIG. 7 contains top, side and end views of the material transport on the upper section of an extension ladder after passing over the transition ramps between the lower and upper section of an extension ladder.

FIG. 7 shows the top, side and end views of the material transport base section on the upper section of a ladder positioned just above transition ramps 46, 48. As shown in FIG. 7, the inside portion of the wheel contact surface is utilized when the wheels travel on the upper section of a ladder.

Figure 8:
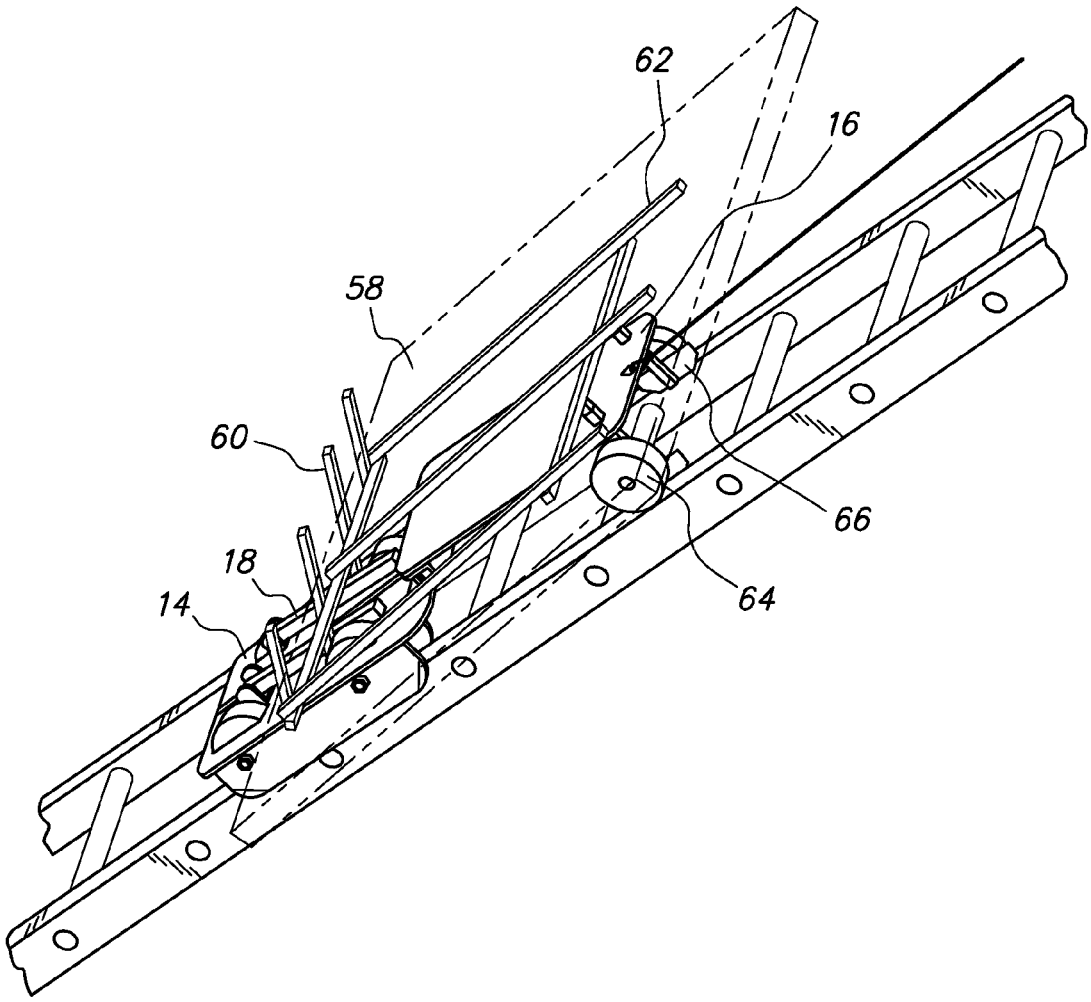
FIG. 8 shows an embodiment of the material transport with additional support components and wheels.
Figure 9:
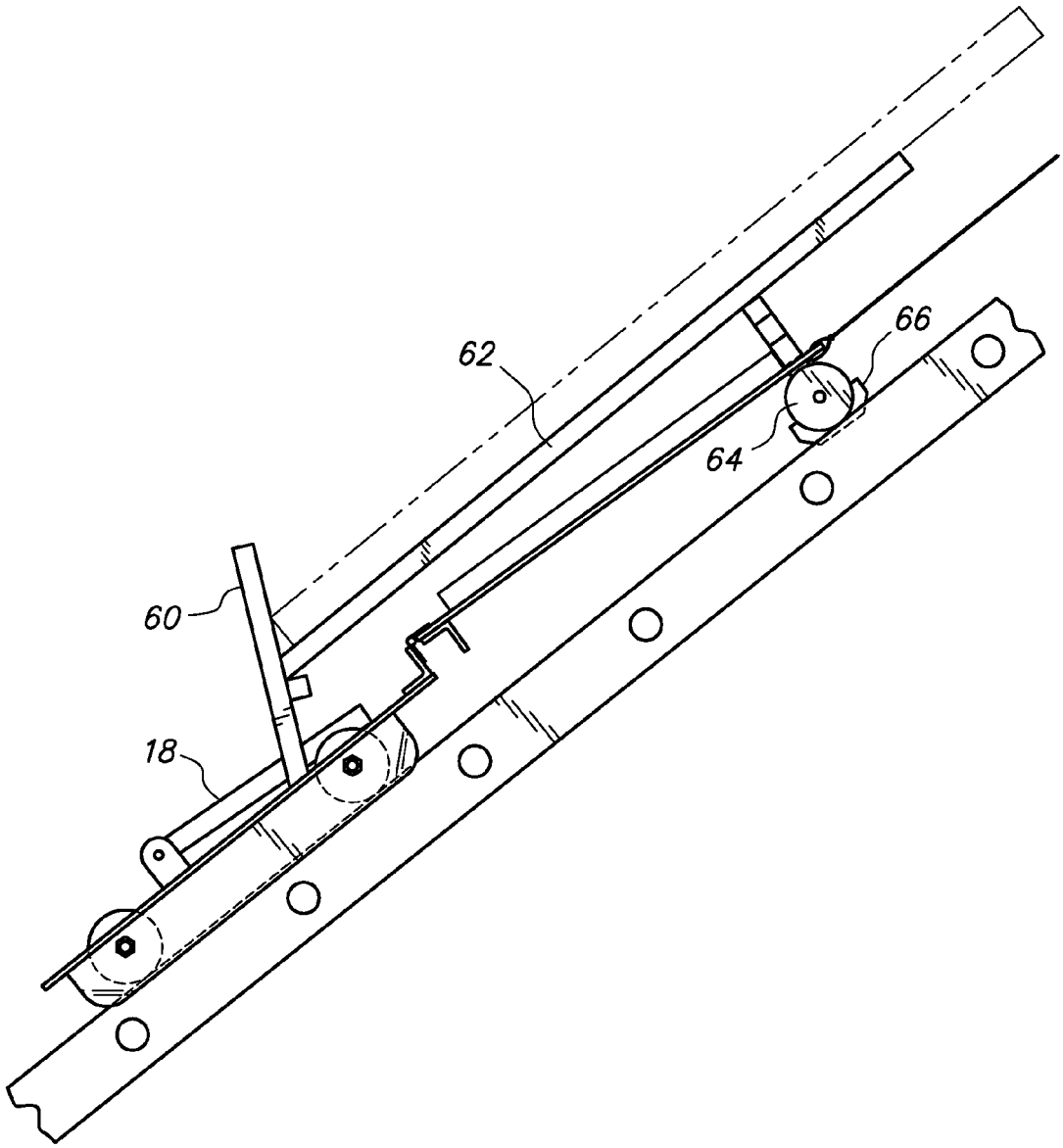
FIG. 9 shows a side view of the embodiment shown in FIG. 8.

The embodiment of the material transport illustrated in FIG. 8 and FIG. 9 utilizes upright load supports 60 and horizontal load supports 62 to support a load 58. Additional wheels 64 are used to provide a transport mechanism for the tray section 16. Wheel supports guides 66 aid in positioning the tray section relative to the ladder rails.

CONCLUSIONS, OTHER EMBODIMENTS, AND SCOPE OF INVENTION

The rooftop material transport apparatus disclosed herein presents a novel device that can be utilized to lift materials to the eave of a roof and/or from the eave of a roof to the peak of the roof. This apparatus can be used on single section ladders or on multi-section, extension ladders.

The base unit of the rooftop material transport apparatus should first be adjusted and secured in place to fit the particular ladder it will be used with. The base unit is adjusted in the same manner whether a single section or multi-section ladder is utilized.

The outside width (the distance between the outside of the ladder rails) of the wide, base section of an extension ladder, or the single section ladder must be measured. After that measurement is determined, the base section 34, 36, 38 of the rooftop material transport must be adjusted so that the distance between the outside guides 26, 32 of the base is approximately 1 inch more than the distance measured for the particular ladder (distance between outside ladder rails). This permits the outside rail guides to contact the outside of the ladder rails when the wheels (and material transport) move excessively to one side of the ladder rails or the transition ramp.

When in operation on a single section ladder (and the wide, base section of an extension ladder), only approximately the outside half of each wheel is in contact with the ladder rails. In essence, the inside half of the wheels will not have contact with the ladder rails. The terms "approximate" and "half" are not to be construed as limiting because only a portion of the wheel needs to contact a surface during use.

The inside half or the wheels comes in contact with the upper, narrow section of the extension ladder when the rooftop material transport is traveling on the upper, narrower section of the extension ladder. While the rooftop material transport apparatus is utilizing the transition ramps between the upper and lower sections of the ladder, the inside portion and or the outside portion of the wheels may be in contact with the ramp as the transport transitions from the lower ladder section to the upper, narrower section.

The wide wheels are of a sufficient width to carry the rooftop material transport on both the wide and narrow sections of the extension ladder. The two transition ramps are typically held in place by a nut and bolt near the top portion of the transition ramp at the ends of the narrower section of the extension ladder. The bottom portion of the transition ramp rests on the wide, base section of the ladder. The transition ramp is kept in position by use of a keeper (the portion of the transition ramp that extends below the top of the ladder rail).

The material transport can be used in conjunction with a ladder to lift material from a first position to a higher position. The material transport will function with single section ladders, extension ladders, telescoping ladders or multiple ladders properly connected. Typically the material transport is raised utilizing mechanical or electromechanical means.

Other examples of the invention will be apparent to those skilled in the art from a consideration of the specification or practice of the invention disclosed herein. It should be evident that this disclosure is by way of example and that various changes may be made by adding, modifying, or eliminating details without departing from the fair scope of the teaching contained in this disclosure. The invention is therefore not limited to particular details of this disclosure except to the extent that the following claims are necessarily so limited. Thus it is intended that the specification and examples be considered as illustrative only, with the true scope and spirit of the invention being indicated by the following claims.

What is claimed is:

1. A material transport system for use with a ladder having at least two ladder rails, the system comprising:

a base assembly having a length, and an adjustable width;

a material support platform hingedly attached to the base assembly, the platform supportable angularly above the base assembly by at least two support tubes hingedly attached to the base assembly;

a left pair and a right pair of rail guides aligned along the length of the base assembly, the rail guides removably attached to the underside of the base assembly; and a left pair and a right pair of wheels axially mounted between each rail guide pair, the bottom edges of the rail guides extending past the bottom edges of the wheels and wherein the left pair of rail guides encloses at least a portion of a first rail of a ladder attachable thereto and the right pair of rail guides encloses at least a portion of a second rail of a ladder attachable thereto;

characterized in that the rail guides and wheels enable the transport system to be pulled along the rails of a ladder by wire, rope, or like component attached to the transport system;

further including a pair of transition ramps for enabling the system to track on an extension ladder having a wider base section and a narrower extension section, the ramps enabling transition from the wider base section of the ladder to the narrower extension section;

wherein the transition ramps are removably attachable to the rails of the narrower extension section of the ladder, the ramps held in position against one or more sides of the rails of the wider base section of the ladder by a keeper feature protruding from the underside of each ramp.

2. The material transport system of claim 1, wherein the contact surfaces of the wheels are of sufficient width to cover the outside edges of the contact surfaces of the rails of the base section of the ladder and the inside edges of the contact surfaces of the rails of the extension section when the base assembly width is adjusted for the ladder width dimension.

3. The material transport system of claim 1, wherein the angle of the material support platform relative to the incline of the ladder is such that the material support platform is roughly parallel to the ground when tracking up the ladder.

4. The material transport system of claim 1, wherein the angle of the material support platform is adjustable by positioning the support tubes against the underside of the platform.

5. The material transport system of claim 1, further including two or more upright load supports and two or more horizontal load supports for supporting a load angularly above the base assembly, the material support platform further including a set of wheels with rail guides, the wheels axially mounted on the upper surface thereof, the platform unfolded at least 180 degrees from the base assembly about a hinge to provide additional load support and additional wheel-to-rail contact.

6. The material transport system of claim 1, wherein the angle of the material support platform is adjustable by positioning the support tubes against the underside of the platform.

7. The material transport system of claim 1, wherein the angle of the material support platform relative to the incline of the ladder is adjusted so that the material support platform is roughly parallel to the ground when tracking up the ladder.

* * * * *